US005288002A

United States Patent [19]

Oh

[11] Patent Number: 5,288,002

[45] Date of Patent: Feb. 22, 1994

[54] SPRING LOADED BALL HOLDER

[76] Inventor: Sangsoo Oh, 102 Arbor Dr., HoHoKus, N.J. 07423

[21] Appl. No.: 664,363

[22] Filed: Mar. 4, 1991

[51] Int. Cl.[5] ..... A45F 5/00

[52] U.S. Cl. ..... 224/248; 224/252; 224/918; 224/919

[58] Field of Search ..... 224/919, 252, 247, 248, 224/918; 206/315.9

[56] References Cited

U.S. PATENT DOCUMENTS

| | | | |
|---|---|---|---|
| 1,625,856 | 4/1927 | Judd | 224/919 |
| 1,911,256 | 5/1933 | Andrew . | |
| 2,074,180 | 3/1937 | Hatley | 224/248 |
| 2,661,129 | 12/1953 | Seaton et al. | 224/919 |
| 2,665,830 | 1/1954 | Fowler . | |
| 2,708,061 | 5/1955 | Kotchka | 224/919 |
| 2,757,698 | 8/1956 | Goodman . | |
| 3,768,709 | 10/1973 | Kinard | 224/919 |
| 3,873,009 | 3/1975 | Goudreau . | |
| 4,062,482 | 12/1977 | Szalony . | |
| 4,065,040 | 12/1977 | Steere . | |
| 4,082,209 | 4/1978 | Sanders . | |
| 4,226,350 | 10/1980 | Detje | 224/247 |
| 4,433,802 | 2/1984 | Liberbaim | 224/251 |

FOREIGN PATENT DOCUMENTS

| | | | |
|---|---|---|---|
| 573899 | 4/1959 | Canada | 224/919 |

*Primary Examiner*—Linda J. Sholl

*Attorney, Agent, or Firm*—Sheldon H. Parker

[57] ABSTRACT

A holder for carrying golf balls is disclosed which has a frame member and a two pair of loop members. The loop members have a diameter greater than half the diameter of a ball but less than the diameter and are retained on the frame in a spaced relationship. A belt clip fixed to the frame attaches the unit to the users clothing.

13 Claims, 10 Drawing Sheets

SPRING LOADED BALL HOLDER

FIELD OF THE INVENTION

This invention relates to a holder for use with golf balls, tennis balls, or the like, and includes means for attachment to the belt of the user.

BACKGROUND OF THE INVENTION

Golf is one of the most popular participator sports in the U.S. and spreading throughout the world. The sport provides players, of all ages, with the challenge to aim and shoot a ball several hundred yards into a small hole. The problem is that many times from point A to point B the ball gets lost or damaged. Once a ball is lost, the player must put a replacement ball into play. Unless the player is carrying a spare ball, he must return to his bag or cart to obtain a replacement ball. It is not unusual for a player to lose one or two balls on a single hole.

Many patents have issued on various means to secure a ball, ether golf or tennis, on a player's clothing. However, for the invention to be commercially successful, the cost of the device must be kept reasonable. The manufacturing cost of the items from which the device is assembled, is generally a major factor affecting the pricing. The cost of the assembly operation is another major cost item. Although the material expense in most of the prior art devices is minimal, the complex construction involved would tend to raise the cost of manufacture. Another major problem in the introduction of a new product to a marketplace, is the cost of manufacture of prototypes and the cost of manufacturing small initial runs of the product. When introducing a new product to the marketplace, few entrepreneurs are willing to make large investments until the product has proven its commercial feasibility. The prior art is replete with golf ball holders and tennis ball holders which have technical merit but which have failed to achieve commercial viability. For example the device of U.S. Pat. No. 3,873,009, discloses a ball holder designed to secure a single ball on a belt. The base has a clip for mounting the holder and interlocking members for joining several holders to one another. A connector tongue is joined at one end to the base and the other to a resilient retaining ring which holds the ball in place. The Goudreau patent is, in the preferred embodiment, formulated from plastic. The tongue 24 and tongue 60 are connected at protrusion 62 and recess 26, thereby producing a connection at a high torque area which is subject to stress each time the ball is inserted or removed.

The Steere patent, U.S. Pat. No. 4,065,040, illustrates a beltmounted device for holding a ball between two opposing metal loops with laterally extending legs joined together by vertical arms. The user's belt is woven through the vertical arms to hold the device in place. The device is composed of several parts which require specific and relatively complex manufacturing. In order to work accurately, the two opposing metal loops must be mirror imaged.

The Fowler patent, U.S. Pat. No. 2,665,830, discloses a device which can be attached to the users belt and used to carry balls and other accessories. The construction of the Fowler device appears to require substantial equipment in that the former must be stamped out and then bent to shape.

U.S. Pat. No. 2,661,129 to Seaton discloses a single ball holder which attaches to the belt. The U shaped portion hooks over the belt and the ball holding rings extend outwardly at right angles to the U shaped portion. The balls are locked in between the two rings and, during removal and insertion, put pressure at the joints connecting the rights to the U shaped portion.

U.S. Pat. No. 2,708,061 issued to Kotchka illustrates a spring system which is affixed to a curved base. The helically wound spring is secured to the base through loops or raised portions in the base; the base is secured to the users belt through use of a U shaped belt hook. The formation of the base and attachment of the spring system and belt hook requires substantial tooling and machinery.

In the Kinard U.S. Pat. No. 3,768,709, a bent wire ball holder is disclosed. U shaped portions form a securing portion which is used to hold the device on clothing. A pair of wire loops extend from the U shaped portions to hold the ball in place. The Kinard device requires a substantial amount of bending and, the fact that the wire must be flexible enough to allow for the unit to be bent into shape and for the balls to be inserted, also allows for distortion of the base and ball holder portions.

Similar to the aforenoted patent is U.S. Pat. No. 2,074,180 to Hatley. Again, the flexibility of the wire to allow for bending into shape also allows for the wire to be distorted.

In U.S. Pat. No. 1,911,256, Andrew, a clip on device which slips over the wearer's belt is disclosed. In one embodiment, the balls are slipped into a partial ring and in a second embodiment, the balls are slipped into vertically placed "fingers". The manufacture on this patent can be difficult in that there are a lot of protrusions and critical dimensions.

U.S. Pat. No. 4,062,482 Szalony, discloses a one piece device for holding balls. The balls are secured vertically with a garment clip extending from the top ball.

U.S. Pat. Nos. 3,777,933, Joliot and 4,082,209, Sanders, both disclose ball holders incorporating a rigid cylindrical housing with clipping means to secure it to clothing.

A wire ball, cigarette, etc. holder is disclosed in U.S. Pat. No. 2,757,698 to Goodman. U.S. Pat. No. 4,433,803 discloses a belt which has vertically placed dual ball holders. In U.S. Pat. No. 4,226,350, the end of a key chain is fitted with a ball which slips into a base secured to a wall or the like.

SUMMARY OF THE INVENTION

The present invention relates to a ball holder which is particularly adapted for holding golf or tennis balls. The ball holder is made of two parts, an extruded clip on base and a spring unit partially inserted into the base. The base is formed with a clip on section which can be placed over a belt, golf bag, etc.

The ball is inserted into the holder by inserting it between two spring rings which, through resiliency, spring back into position, holding the ball in place.

BRIEF DESCRIPTION OF THE DRAWINGS

The objects and advantages of the instant invention will become apparent when the specification is read in conjunction with the drawings, wherein.

DETAILED DESCRIPTION OF THE PREFERRED EMBODIMENTS OF THE INVENTION

Figure 1:
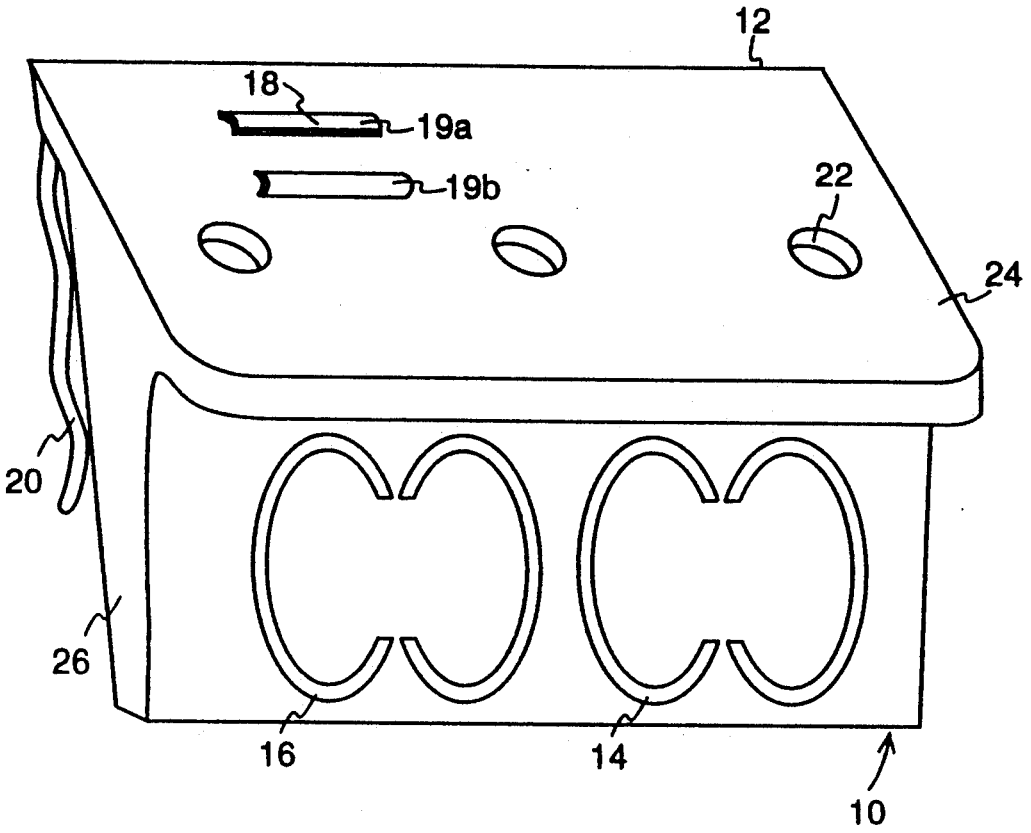
FIG. 1 is a perspective view of the assembled device of the instant invention.

FIG. 1 illustrates a perspective view of one of the embodiments of the spring loaded ball holder 10. The base 12 can be formed from an extruded plastic, a process which is well known in the art. The ball retaining rings 14 and 16 can be either set into the spring loaded ball holder 10 while the extruded base 12 is still hot or the ball retaining rings 14 and 16 can be heated and forced into the partly melted base 12 back section 26 after the extrusion step. The ball rings 14 and 16 are formed from metal or plastic in individual circles, as illustrated in the instant figure, or continuous coil as discussed in more detail further herein.

Tee holders 22 are drilled into the coiled plastic base 12 top section 24 to allow the user to carry tees. The dimension of the tee holder holes 22 must be sufficiently small to prevent the tee from falling through the hole, while still being large enough to allow the tee to stay secure. The number of tee holders 22 can vary and should be left to the convenience of manufacture.

The pencil holder retaining tabs 18 are a pair of raised quarter circular flanges 19*a* and 19*b*. They are used to retain a pencil or other writing instrument on the base 12 top section 24. The flanges 19*a* and 19*b* can be slightly separated and tapered to allow the pencil to slide in and out or separated further to allow the pencil to be snapped in and out. The pencil holder 18 must be positioned on the plastic base 12 top section 24 to allow the pencil to clear the tee holders 22 and for easy access.

The garment clip 20 extends from the base 12 top section 24 parallel with the base 12 bottom section 26. The garment clip 20 is commonly used in the prior art and is unique only in combination with the instant device. It can be formed of metal wire or molded as part of the plastic base 12.

Figure 2:
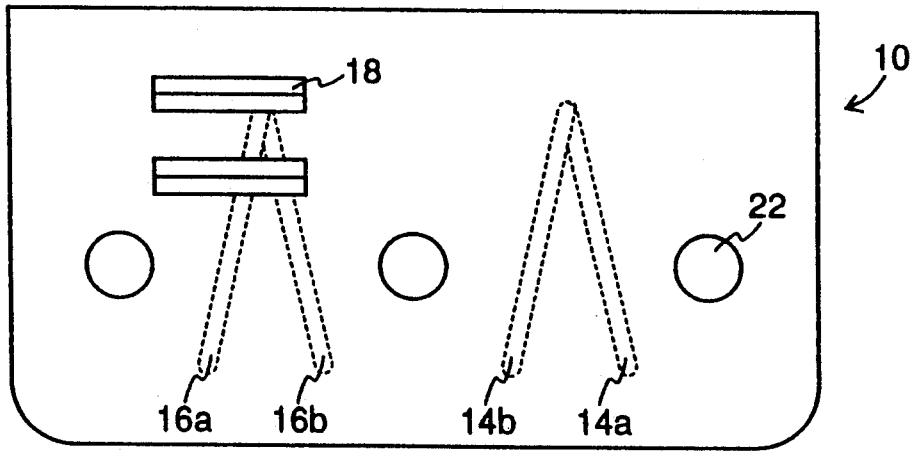
FIG. 2 is a top view of the instant device.

In FIG. 2 the ball rings 14 and 16 are shown in phantom to illustrate placement. The ball rings 14 and 16, as used in FIG. 2, are not continuous, but rather two separate contiguous spring units. The two pairs of ball retaining rings 14*a* and 14*b* and 16*a* and 16*b*, can be two unconnected circular units secured to the base at a predetermined angle. The ball retaining rings 14*a* and 14*b* can, as an alternative within this embodiment, be connected to the ball retaining rings 16*a* and 16*b*. This provides the advantage of the predetermined angle of the two paris of retaining rings being maintained constant relative to each other and not being subject to relative moment during cooling.

Figure 3:
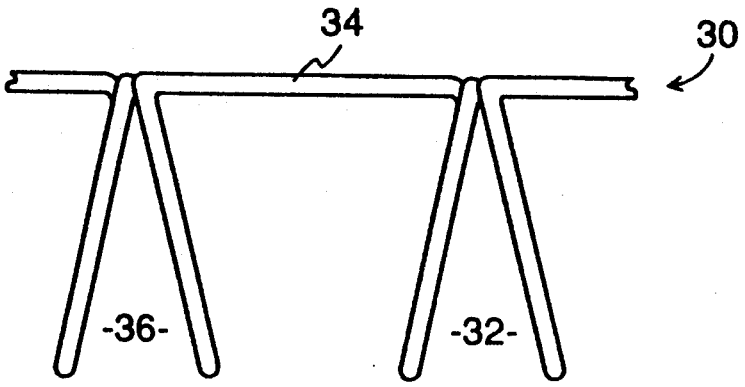
FIG. 3 is a side view of one embodiment of spring like member for use in the present invention.
Figure 4:
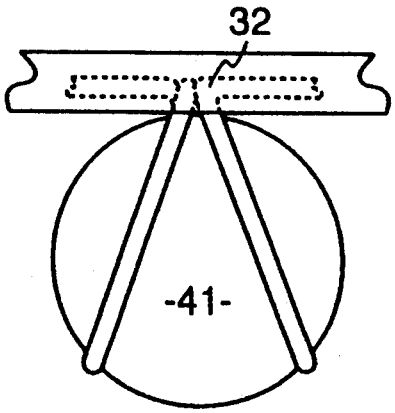
FIG. 4 is a side view of the embodiment of a spring like member of FIG. 3, shown with a ball retained within the spring.

FIG. 3 illustrates an alternative to the ball rings 14 and 16, wherein spaced coil 30 is placed in the base 12 bottom section 26. The wire or plastic is manufactured on a continuous basis and is inserted into the bottom section 26 of the base 12 as previously described. The spaced coil 30 is formed from ring pair 32 and ring pair 36 separated by a spacer wire 34. The spacer wire 34 must be of sufficient length to allow clearance between the balls being held in the ring pairs 32 and 34. The spaced coil 30 is a continuous repetition of ring pair 32, ring pair 36 and spacer wire 34. The spaced coil 30 can be cut prior to insertion into the individual ball holder or can be placed in the ball holder 10 immediately after extrusion and out when the ball holders 10 are cut into individual units. FIG. 4 illustrates the angle placement for the ring pair 32 and the placement of the ring pair 32 while holding a ball 41.

Figure 5:
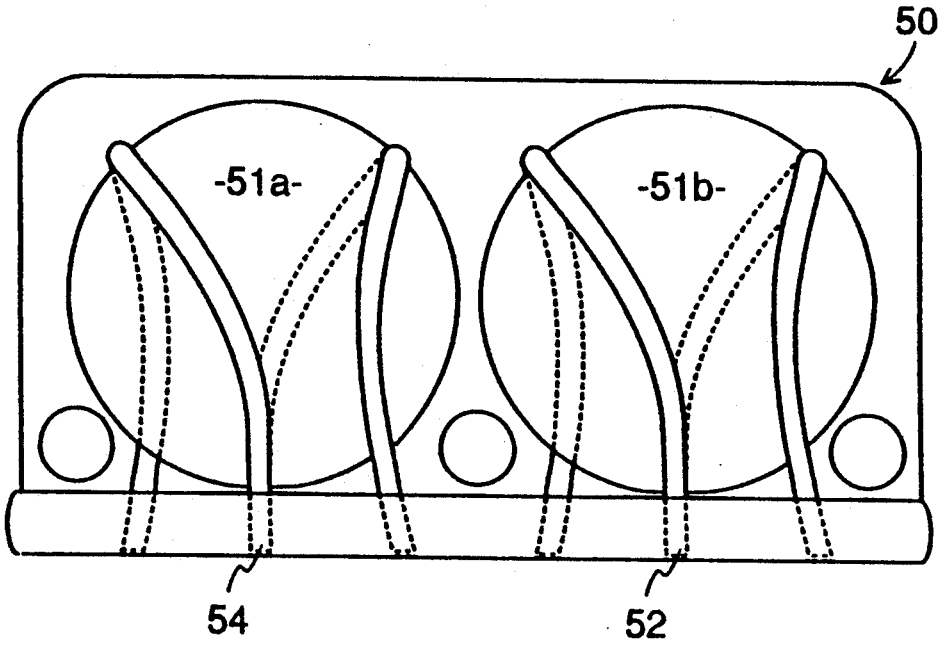
FIG. 5 is a side view of another embodiment of a pair of spring members for use in the present invention, shown with two retained balls.

FIG. 5 illustrates an alternate embodiment to the instant device. The spring like coils 52 and 54 have been cut into individual pairs and inserted into the ball holder device 50 as previously mentioned. The embodiment of FIG. 5 provides the advantage of a wider base than that of the individual coils 14 and 16 of FIG. 1 and 2. The wider base will cut the loss of elasticity during use.

Figure 6:
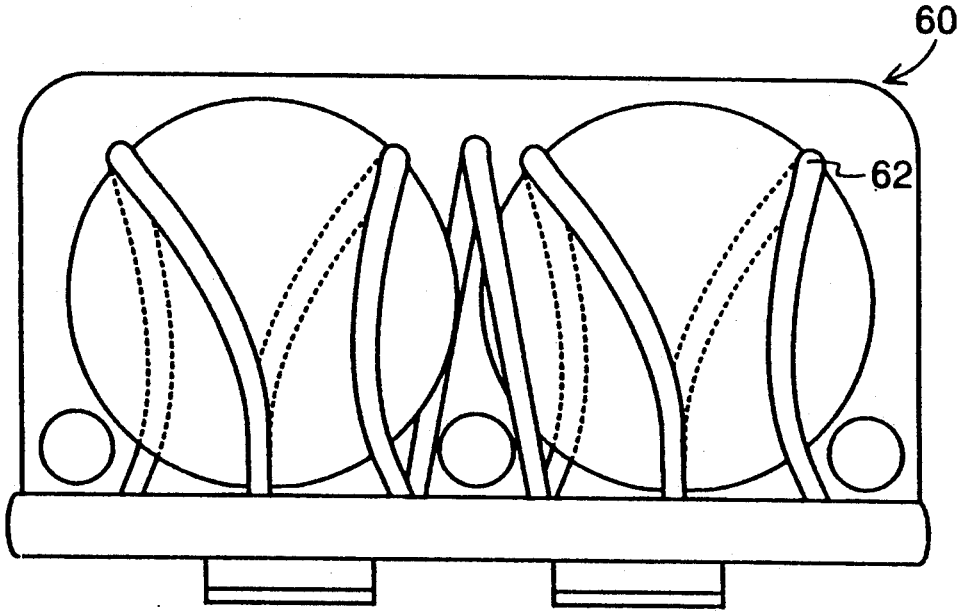
FIG. 6 is an end view of another embodiment of a single spring member for use in the present invention, shown with two retaining balls.

In FIG. 6 another embodiment is shown wherein the entire coiled section 62 is inserted into the ball holder 60. The coiled section 62 is placed in the ball holder 60 at the time of extrusion and cut with the individual units. This would allow for extreme ease of manufacture and cost savings. An alternate garment clip is illustrated in the instant embodiment wherein to garment clips 64 and 66 are used. As previously stated, the garment clips 64 and 66 and well known in the prior art and are claimed to be novel only in conjunction with the instant invention.

Figure 7:
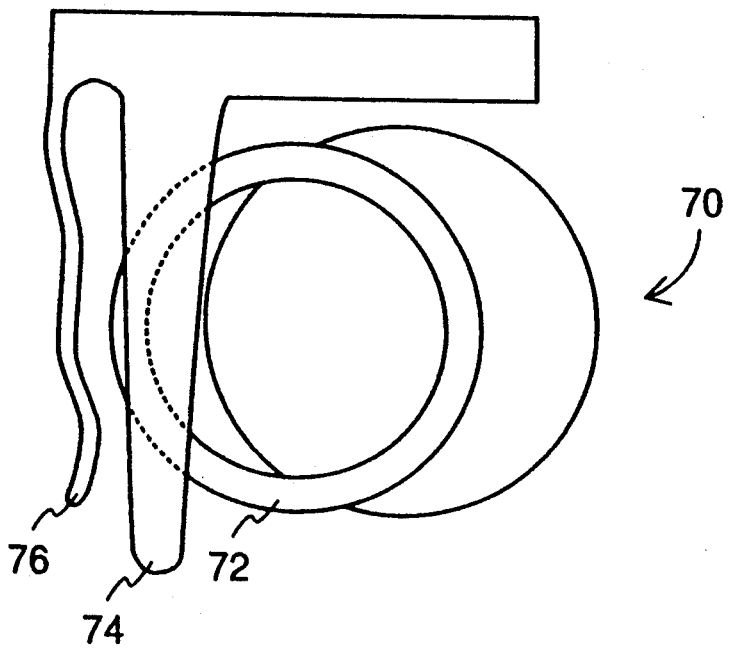
FIG. 7 is an end view of another embodiment of a flat plastic spring member for use in the present invention, shown with a retained ball.

FIG. 7 illustrates the preferred placement of the coils 72 in the back 74 of the base 70, when plastic is used instead of metal. The replacement of plastic for metal in any embodiment of the instant invention is possible provided adjustments to the coil formations are made. The plastic coils are preferably flat spirals rather than round wire. The plastic of the coil will fuse to the plastic of the holder providing a strong support. The plastic coil 72 can extend through the back 74 of the holder 70 to provide additional grip to the garment holders 76.

Figure 8:
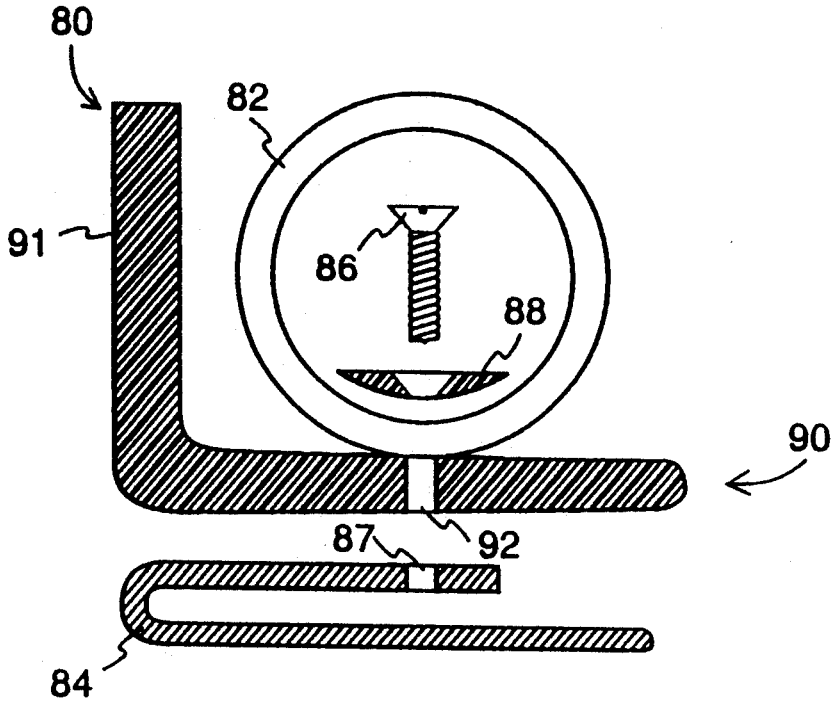
FIG. 8 is an exploded end view of another embodiment of a spring member for use in the present invention.
Figure 9:
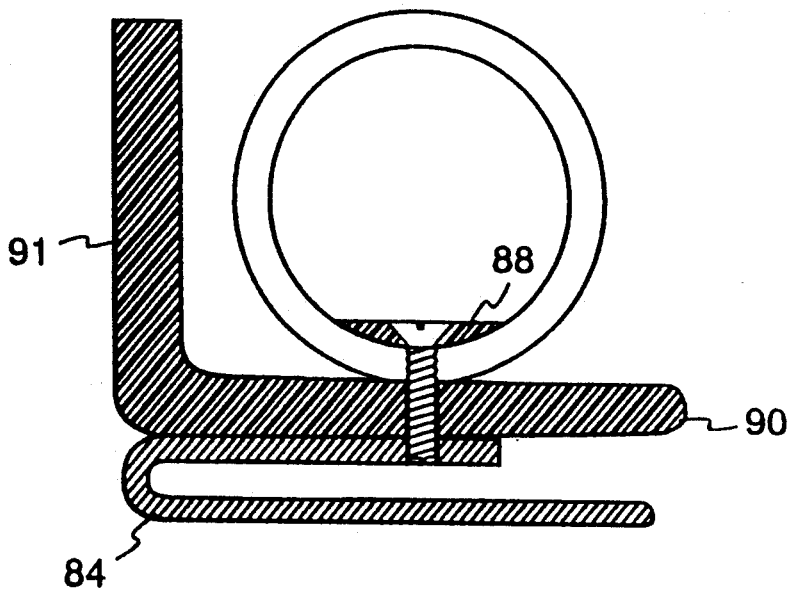
FIG. 9 is an end view of the embodiment of FIG. 8, showing the spring member, holder and retainer mechanism in assembled form.

In FIG. 8 the ball holder 80 is produced as a simple L shaped unit. The spring 82 is connected to the corner extension 90 of the ball holder 80 through use of a screw 86. A hole 92 is drilled through the corner extension 90, and into the metal clip 84. An insert 88 is placed through the hole 92 and the hole 87, locking the spring 82 against the corner extension 90. Screw 86 is inserted through the insert 88 to the metal clip 84 where it is secured, as shown in FIG. 9. The top 91 and corner extension 90 can, in this embodiment, be manufactured from either plastic or metal.

Figure 10:
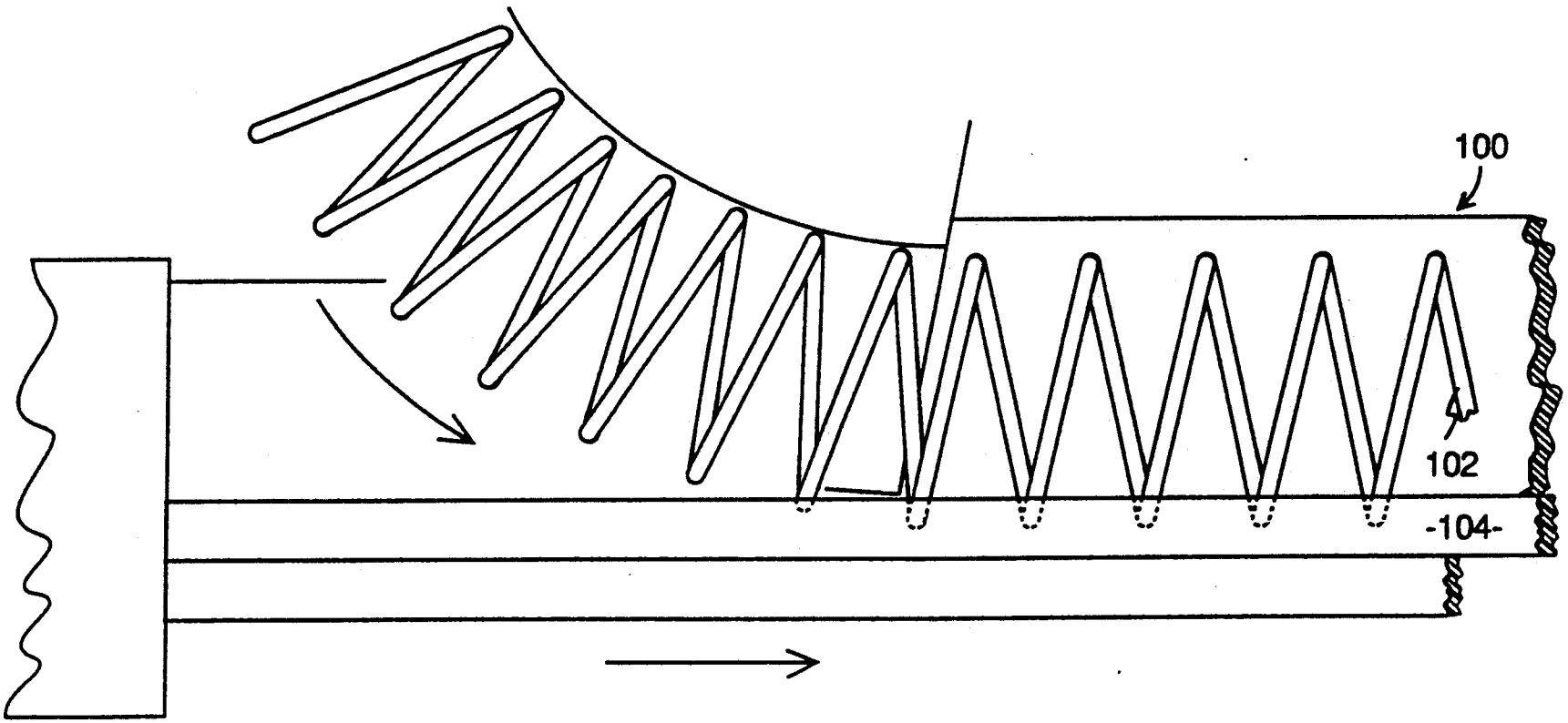
FIG. 10 is a fragmentary side view of a system for the continuous manufacture of the device of the present invention.

The coil and plastic ball holder of FIG. 6 is shown in FIG. 10 wherein extruded ball holder 100 is shown prior to being cut into individual units. The continuous coil 102 is shown being inserted into the back portion 104 of the ball holder 00. The wire or plastic spring can be continuously merged with the holder back portion 104 right out of the extruder. A gear like member can be used to control the spring spacing and feed rate. A guide frame can be used with either a wheel or gear.

Figure 11:
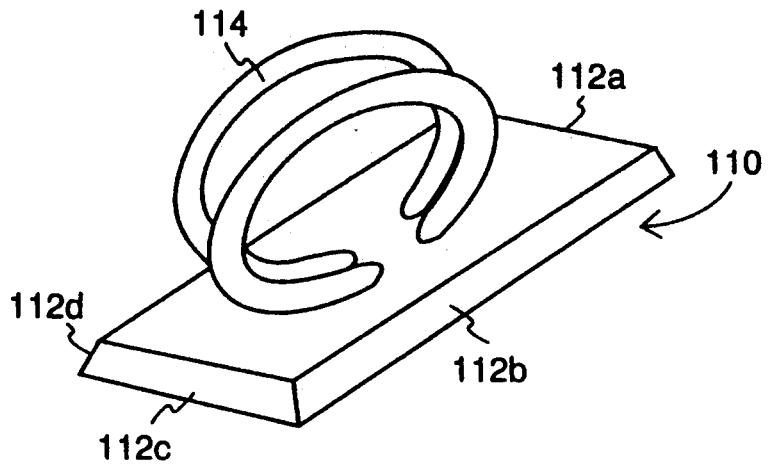
FIG. 11 is a perspective view of an alternative ball retaining mechanism.
Figure 12:
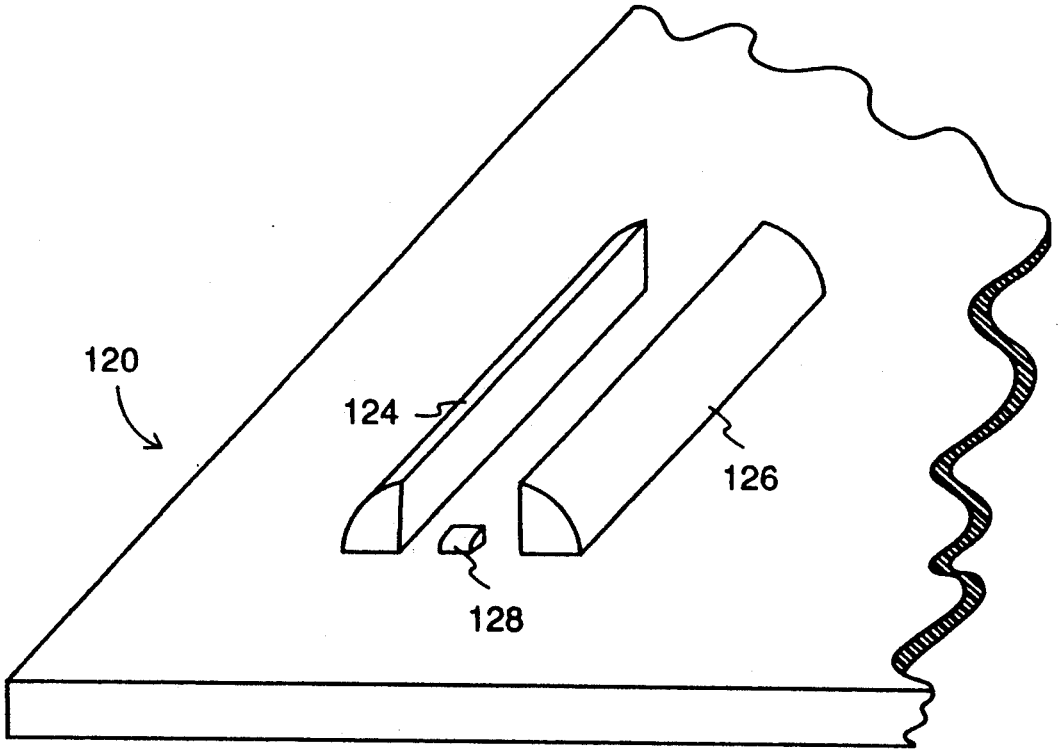
FIG. 12 is a fragmentary perspective view of a modification of the base unit for use in conjunction the clip.

FIGS. 11 and 12 illustrate another embodiment of the instant disclosure wherein the ball holder insert, indicated generally as 110, is slid into the ball holder receiving slot 122 of the base 120. The ball holder insert 110 has beveled edges 112*a*, 112*b*, 112*c* and 112*d* which match the bevel or incline of the lock tabs 124 and 126. The ball holder insert 110 slides firmly between the locking tabs 124 and 126 and is prevented from sliding out by the raised section 128, as well known in the art. Any convenient attachment and locking mechanism can be used in accordance with the present invention. The pair of rings 114 is inserted into the ball holder insert 110 proximate the center point 16. The rings 114 can be inserted into the center point 116 through any means which will correspond to the materials. For example they can be molded in place or inserted into a formed piece through the heating of the plastic piece. The rings 114 can be manufactured of metal or plastic as can be the ball holder insert 110. The rings 114 and the ball holder insert 110 do not have to be manufactured from the same material, however, the adhering means must be adjusted to correspond to the material(s) being used. The ball holder receiving slot 122 can run either transverse or longitudinal, with respect to the top section 24. The number of ball holder receiving slots 122 which can be placed on the base 120 will vary with the positioning of the ball holder receiving slots 122 and the size of the base 120. In the most common sizing, two ball holder receiving slots 122 can be placed transversely and one longitudinally. In the instance of the longitudinal use of a single ball holder insert 110, the insert could accommodate a pair of balls.

Figure 13:
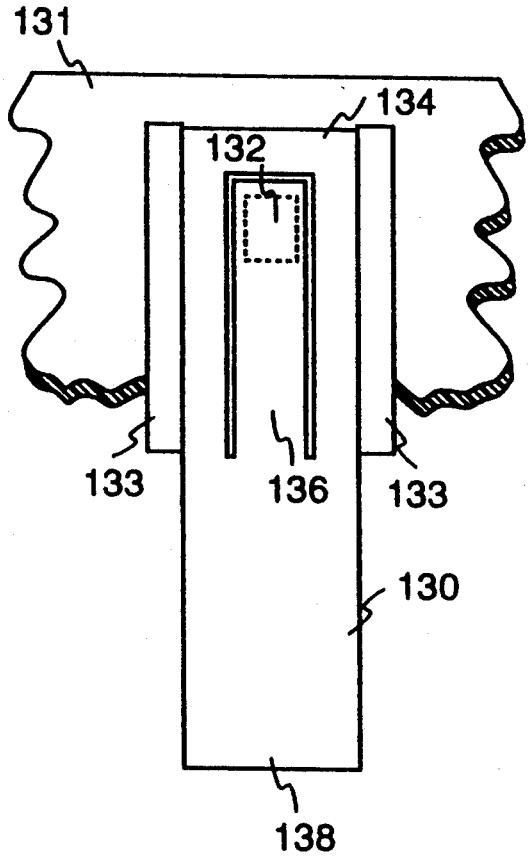
FIG. 13 is a front view of the clip which attaches the base unit the users clothing.

FIG. 13 illustrates one modification of a belt clip which can be used in accordance with the present invention. As illustrated the belt clip unit can be accommodated in the manner illustrated in FIG. 12 with respect to the ball holder unit 110 and the locking tabs 124 and 126. The locking tabs or guide rails 133 of FIG. 13 correspond to the locking tabs 124 and 126 of FIG. 12. The free end 138 of the belt clip member 130, Would slid over the belt of the user. The rails 133 retain the removable clip unit 130 in place while the cantilevered section 136 of the belt clip unit carries an element 132 which interacts with a corresponding element, not shown, on the base of the ball holder 20 unit. Thus the upper end 134 of the clip unit is fixed to the base while the lower end is free to engage a belt.

Figure 14:
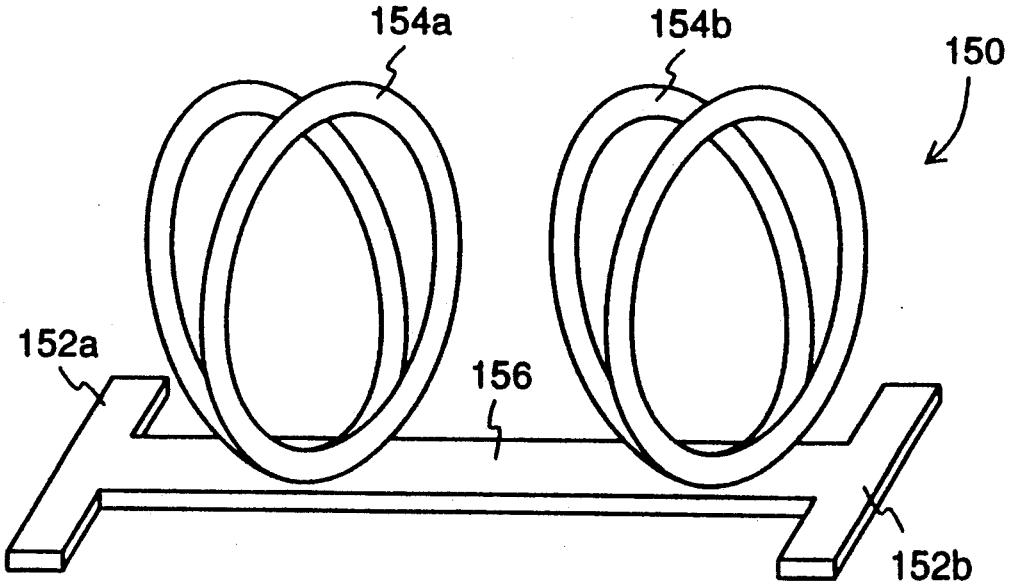
FIG. 14 is a perspective view of the holder insert for an additional embodiment to the instant invention.
Figure 15:
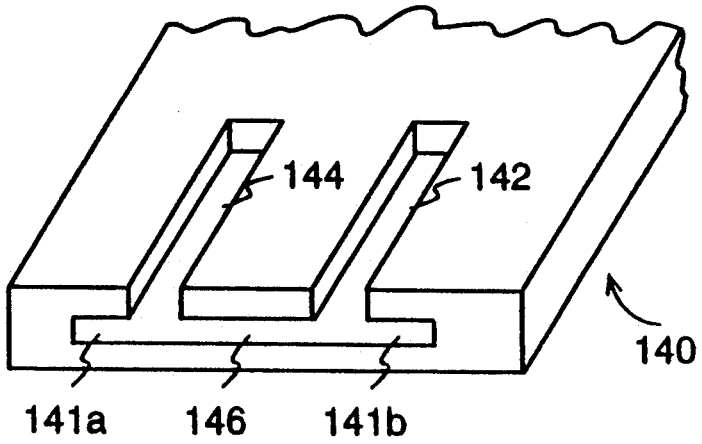
FIG. 15 is a perspective view of the base to be used with the ball holder insert of FIG. 14.

In another embodiment, as illustrated in FIG. 14, the ball holder retaining rings 150 are formed of pairs of wire or plastic rings 154*a* and 154*b*. The rings are secured to the plastic or metal base section 156, by soldering, welding or other means compatible with the materials, as well known in the art. Alternatively, the rings and base section can be formed of a continuous piece of wire. The base unit 140, as illustrated in FIG. 15, is provided with an internal recess 146, which accommodates the ball holder unit 150. The end units 152*b* and 152*a* fit into the end regions 141*a* and 141*b* respectively, of the recess 146. The ring units 154*a* and 154*b* fit through the channels 144 and 142 respectively. Thus the base portion of the ball holder unit 150 is hidden within the recess 146 while the ball holder units extend upwardly and can accommodate a pair of balls. The ball holder unit 150 can be force fit in place or fixed in place by any other convenient means.

Figure 16:
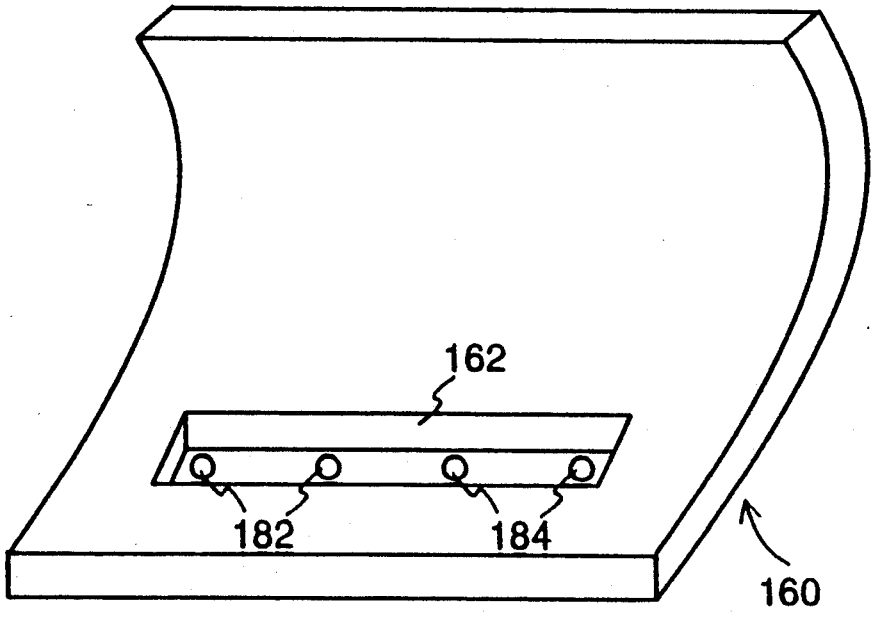
FIG. 16 is perspective an alternate base for use in the instant invention.
Figure 17:
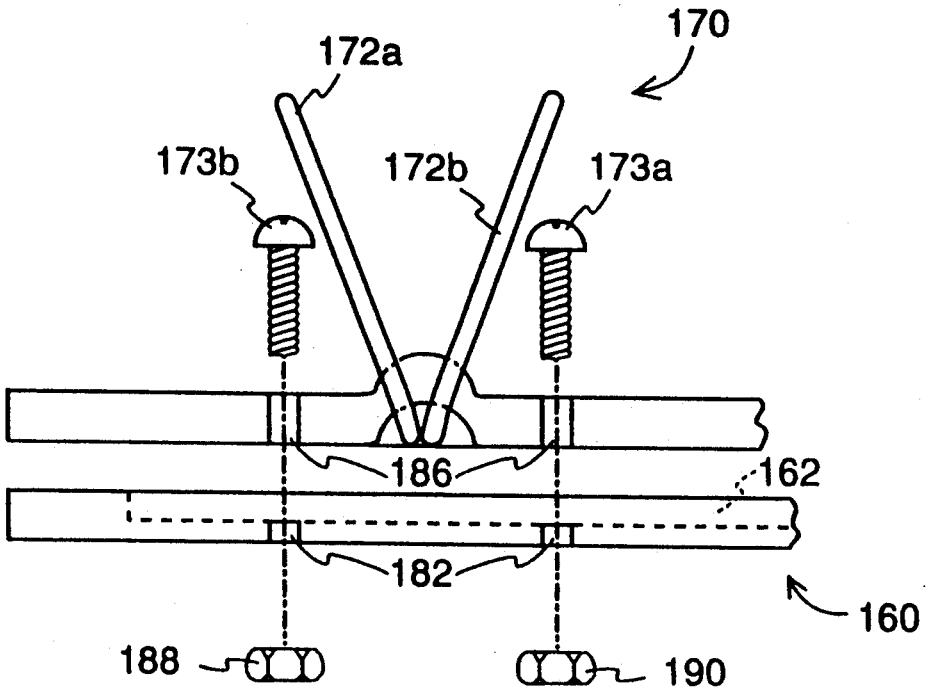
FIG. 17 is an exploded side view of the ball holder insert for use with the base of FIG. 16

FIGS. 16 and 17 illustrates another embodiment of the invention in which the ball retainer rings 172*a* and 172*b* are held in place on the ball holder 160, by means of a clamping mechanism. The base unit of the ball holder 160 is provided with a recessed region 162. The recessed region 162 can be a partial recess as illustrated in FIG. 16, or a recess which runs the entire width of the ball holder 160. The recess region running the entire width allows the ball holder 160 to be extruded and therefore renders the device highly economical to manufacture. The recessed section 162 is provided with pairs of screw holes 82 and 184. A clamp member 174 is dimensioned to fit within the recessed region 162. The clamp member 174 is provided with screw holes 186, which are aligned with the screw holes 182 in the recessed region 162. Screws 173*b* and 173*a* are inserted through screw holes 186 and 812 and secured in position with nuts 188 and 190. The clamp member 174 is manufactured from either metal or plastic and is used to secure the ball rings 172*a* and 172*b* in position. There can be one or more ring sets included in the clamp member 174, depending upon width of the ball holder 160. Alternatively, particularly where the clamp member 174 is made of a plastic material, means other than nuts and screws can be used to secure the clamp in place. For example, solvent welding, sonic fusion and adhesives, can be employed.

It should be noted that the ball holder units, as described above, can be worn on either the right or left of the users body, depending on whether they are right or left handed. Any statements made herein as to placement of the ball holder units, or material to be used are made only for description purposes and are not meant to limit the scope of the invention.

I claim:

1. A holder for carrying golf balls comprising:

a frame member having a vertical back section and a horizontal top section; said vertical back section having a top, bottom, first side and second side;

a first pair of loop member and second pair of loop members, each of said pair of loop members having a diameter greater than half the diameter of the ball but less than the diameter of said ball, retaining means for retaining said loop members on said first side of said frame member in a spaced relationship;

said horizontal top section being connected to the top of the vertical back section and extending over the first side of the vertical back section and said first and second pair of loop members; said horizontal top section forming a substantially flat horizontal upper surface;

means formed in said substantially flat horizontal upper surface for retaining additional golf accessories; and a belt clip means, said belt clip means being fixed to said frame member on the second side of said vertical back section for allowing said frame member to be affixed to a users belt with the horizontal top section positioned above the loop members.

2. The holder of claim 1, wherein said retaining means is an elongated rigid member having at least one raised section, and further including securing means, wherein said securing means affixes said retaining means to said frame member and wherein said first pair of loop member passes through one of said at least one raised sections, thereby securing said first pair of loop members to said frame.

3. The holder of claim 2, wherein said frame includes a recessed region, said recessed region having dimensions which correspond to the dimensions of said elongated rigid retaining member, and wherein said retaining member is positioned within said recessed region.

4. The holder of claim 2, wherein said elongated rigid member has at least two raised sections and wherein each of said first pair and said second pair of loop members passes through one of said at least two raised sections, thereby securing each of said pair of loop members to said frame.

5. The holder of claim 1, wherein said retaining means includes loop holder means and raised clips, said raised clips being on said first side of said back section, and being dimensioned to engage and retain said loop holder means, at least said first pair of loops being secured to said loop holder means.

6. The holder of claim 5, wherein said loop holder means is formed of at least first pair of loops is secured to said loop holder means by being partly embedded into said loop holder means.

7. The holder of claim 6, wherein said frame member is an extruded member and wherein said raised clips extended longitudinally with respect to said frame member.

8. The holder of claim 1, wherein said frame member is a plastic member and at least said first pair of loops is secured to said frame member by being partly embedded in said frame member.

9. The holder of claim 8, wherein said first pair of loops and said second pair of loops are secured to said frame member by being partly embedded into said frame member.

10. The holder of claim 9, wherein said first pair of loops and said second pair of loops are formed from a single spring member.

11. The holder of claim 1, wherein said belt clip means is molded as a unitary part of said frame member.

12. The holder of claim 10, wherein said belt clip means is secured to said frame member by raised clips, said raised clips being on said second side of said back section, and being dimensioned to engage and retain said belt clip means.

13. The holder of claim 1, wherein said frame member includes a first elongated recessed region in said first side thereof, said recessed region extending at least a major portion of the distance from a first edge of said frame toward an opposing second edge of said frame, a loop retaining member positioned in said first elongated recessed region and secured thereto, said loop members being secured between said recessed region and said loop retaining member.

* * * * *